US008549798B2

(12) United States Patent
VandenBerg

(10) Patent No.: US 8,549,798 B2
(45) Date of Patent: Oct. 8, 2013

(54) AERODYNAMIC ROOF LIFT-PREVENTION DEVICE

(76) Inventor: Charles J. VandenBerg, Highland Beach, FL (US)

( * ) Notice: Subject to any disclaimer, the term of this patent is extended or adjusted under 35 U.S.C. 154(b) by 1824 days.

(21) Appl. No.: 11/622,747

(22) Filed: Jan. 12, 2007

(65) Prior Publication Data

US 2007/0193135 A1 Aug. 23, 2007

Related U.S. Application Data

(60) Provisional application No. 60/764,193, filed on Feb. 1, 2006.

(51) Int. Cl.
*E04H 9/14* (2006.01)

(52) U.S. Cl.
USPC ..... 52/84; 52/24; 52/173.1; 244/123.1

(58) Field of Classification Search
USPC ..... 52/84, 741.3, 24, 173.1, 64, 65, 72; 244/123.1; 343/887; 296/180.1–180.5; 446/217, 218
See application file for complete search history.

(56) References Cited

U.S. PATENT DOCUMENTS

| | | | | |
|---|---|---|---|---|
| 2,206,040 | A | 7/1940 | Ludington | |
| 2,270,537 | A * | 1/1942 | Ludington | 52/173.1 |
| 2,270,538 | A | 1/1942 | Ludington | |
| 2,453,403 | A | 11/1948 | Bogardus | |
| 2,947,989 | A * | 8/1960 | Ford et al. | 343/757 |
| 3,108,766 | A | 10/1963 | Beckman | |
| 3,233,456 | A * | 2/1966 | Mills | 73/170.05 |
| 3,280,524 | A | 10/1966 | Hull | |
| 3,794,275 | A | 2/1974 | Satter | |
| 3,817,009 | A | 6/1974 | Elder | |
| 3,828,498 | A * | 8/1974 | Jones | 52/173.1 |
| 3,974,369 | A * | 8/1976 | Chmela et al. | 362/190 |
| 4,005,557 | A * | 2/1977 | Kramer et al. | 52/173.1 |
| 4,191,505 | A * | 3/1980 | Kaufman | 415/2.1 |
| 4,204,271 | A * | 5/1980 | Braly | 362/145 |
| 4,237,384 | A * | 12/1980 | Kennon | 290/55 |
| 4,364,709 | A * | 12/1982 | Tornquist | 416/132 B |
| 4,409,761 | A * | 10/1983 | Bechtel | 52/1 |
| 4,506,483 | A | 3/1985 | Phalen, Jr. | |
| 4,583,337 | A | 4/1986 | Kramer et al. | |
| 4,608,792 | A | 9/1986 | Gerber | |
| 4,632,340 | A | 12/1986 | Duea | |
| 4,736,562 | A | 4/1988 | Kelly | |
| 4,841,706 | A | 6/1989 | Resan | |
| 4,888,930 | A | 12/1989 | Kelly | |

(Continued)

FOREIGN PATENT DOCUMENTS

| | | |
|---|---|---|
| DE | 3829408 | 8/1988 |
| GB | 2241260 | 8/1991 |

*Primary Examiner* — Brian Glessner
*Assistant Examiner* — Brent W Herring
(74) *Attorney, Agent, or Firm* — Price Heneveld LLP

(57) ABSTRACT

A turbulence-creating device is mounted to the roof, such that high winds flowing across the roof are caused to become turbulent, thereby interfering with the laminar flow and lift which would otherwise be created. The turbulence-creating devices comprise generally V-shaped or curved spoilers, many of which are pivotally mounted to a vertical mast attached to the roof such that the spoilers face in the direction of the oncoming wind and are shaped to disturb the laminar flow, thereby preventing lift from being generated. In some embodiments, fixed omnidirectional spoilers with curved sides are provided.

25 Claims, 8 Drawing Sheets

(56) References Cited

U.S. PATENT DOCUMENTS

| | | | | |
|---|---|---|---|---|
| 4,926,596 | A | 5/1990 | Yeamans | |
| 4,945,691 | A | 8/1990 | Whitman | |
| 5,374,098 | A | 12/1994 | Nelson | |
| 5,573,026 | A | 11/1996 | Griffith | |
| 5,579,619 | A | 12/1996 | Godschalx | |
| 5,669,758 | A * | 9/1997 | Williamson | 416/4 |
| 5,709,419 | A * | 1/1998 | Roskey | 290/55 |
| 5,784,846 | A | 7/1998 | Godschalx | |
| 5,918,423 | A | 7/1999 | Ponder | |
| 5,983,572 | A | 11/1999 | Laboy | |
| 6,195,906 | B1 * | 3/2001 | Stoll | 34/80 |
| 6,206,747 | B1 * | 3/2001 | Skwarek | 446/217 |
| 6,212,829 | B1 | 4/2001 | Webb et al. | |
| 6,239,506 | B1 * | 5/2001 | Roskey | 290/55 |
| 6,437,457 | B2 * | 8/2002 | Roskey | 290/55 |
| 6,530,816 | B1 * | 3/2003 | Chiu | 446/217 |
| 6,601,348 | B2 | 8/2003 | Banks et al. | |
| 6,606,828 | B1 | 8/2003 | Lin et al. | |
| 6,640,518 | B2 | 11/2003 | Bol | |
| 6,905,093 | B2 * | 6/2005 | Dryer et al. | 244/3.28 |
| 7,315,093 | B2 * | 1/2008 | Graham, Sr. | 290/55 |
| 2003/0133782 | A1 * | 7/2003 | Holter et al. | 415/4.2 |
| 2005/0017514 | A1 * | 1/2005 | Tocher | 290/55 |
| 2005/0180851 | A1 * | 8/2005 | Gordon | 416/132 B |
| 2006/0137348 | A1 * | 6/2006 | Pas | 60/641.1 |
| 2006/0232102 | A1 * | 10/2006 | Steel | 296/180.1 |
| 2006/0244264 | A1 * | 11/2006 | Anderson et al. | 290/44 |
| 2008/0143117 | A1 * | 6/2008 | Shen et al. | 290/55 |
| 2008/0315592 | A1 * | 12/2008 | Branco | 290/55 |
| 2009/0167025 | A1 * | 7/2009 | Graham, Sr. | 290/55 |

* cited by examiner

AERODYNAMIC ROOF LIFT-PREVENTION DEVICE

CROSS-REFERENCE TO RELATED APPLICATIONS

This application claims priority under 35 U.S.C. §119(e) on U.S. Provisional Application No. 60/764,193 entitled Aerodynamic Roof Lift-Prevention Device, filed on Feb. 1, 2006, by Charles J. VendenBerg, the entire disclosure of which is incorporated herein by reference.

BACKGROUND OF THE INVENTION

The present invention relates to a system and method to prevent wind damage to roofs. In areas where high winds can occur, wind damage to roofs, and particularly flat roofs or shallow pitched roofs, can be significant. The laminar flow of high velocity winds across the surface of a flat roof generates lift which frequently results in detachment of roofing material, particularly where large sheets of material are joined along seams and only adhesively attached to the underlying roof support members at spaced locations. The lift caused by high winds across the surface of a roof initially tends to lift the roofing fabric or covering from the edges of the roof, followed by the tearing and removal of the entire roof covering, and subsequently the underlying roof structure. Such winds typically accompany severe storms, such as hurricanes, and, upon the destructive removal of the roof covering, further damage to the building structure and its contents results due to the intrusion of wind and rain directly into the building.

Some efforts have been made to provide structures at the edge of a roof to prevent the initial tearing of roof material from the surface of the roof, however, such structure is not effective in the central area of the roof on relatively large buildings which, during storms, can lift away, be torn, and otherwise destroyed by the lift forces caused by laminar flow of wind across the flat or slightly inclined roof surface. Accordingly, there exists a need for a system by which an entire roof surface is protected from the lift forces generated by high winds flowing along the surface of the roof during storms.

SUMMARY OF THE INVENTION

The system of the present invention addresses this need by providing a turbulence creating device which is mounted to a roof in sufficient number and spaced such that high winds flowing across the roof are caused to become turbulent, thereby interfering with the laminar flow and lift which would otherwise be created. Thus, the system of the present invention provides protection for the entire roof by preventing lift forces from being generated along the entire roof surface.

In a preferred embodiment of the invention, the turbulence-creating devices comprise generally V-shaped or curved spoilers which are pivotally mounted to a vertical mast attached to the roof such that the spoilers face in the direction of the oncoming wind and are shaped to disturb the laminar flow, thereby preventing lift from being generated. In some embodiments, fixed omnidirectional spoilers are provided. The spoilers may also generate a downward force which tends to secure the roof in place during high wind conditions. The configurations of the generally V-shaped, curved, or fixed spoilers provide the desired turbulent effect on the wind as well as provide downward forces for the roof structure.

These and other features, objects and advantages of the present invention will become apparent upon reading the following description thereof together with reference to the accompanying drawings.

DETAILED DESCRIPTION OF THE PREFERRED EMBODIMENT

Figure 1:
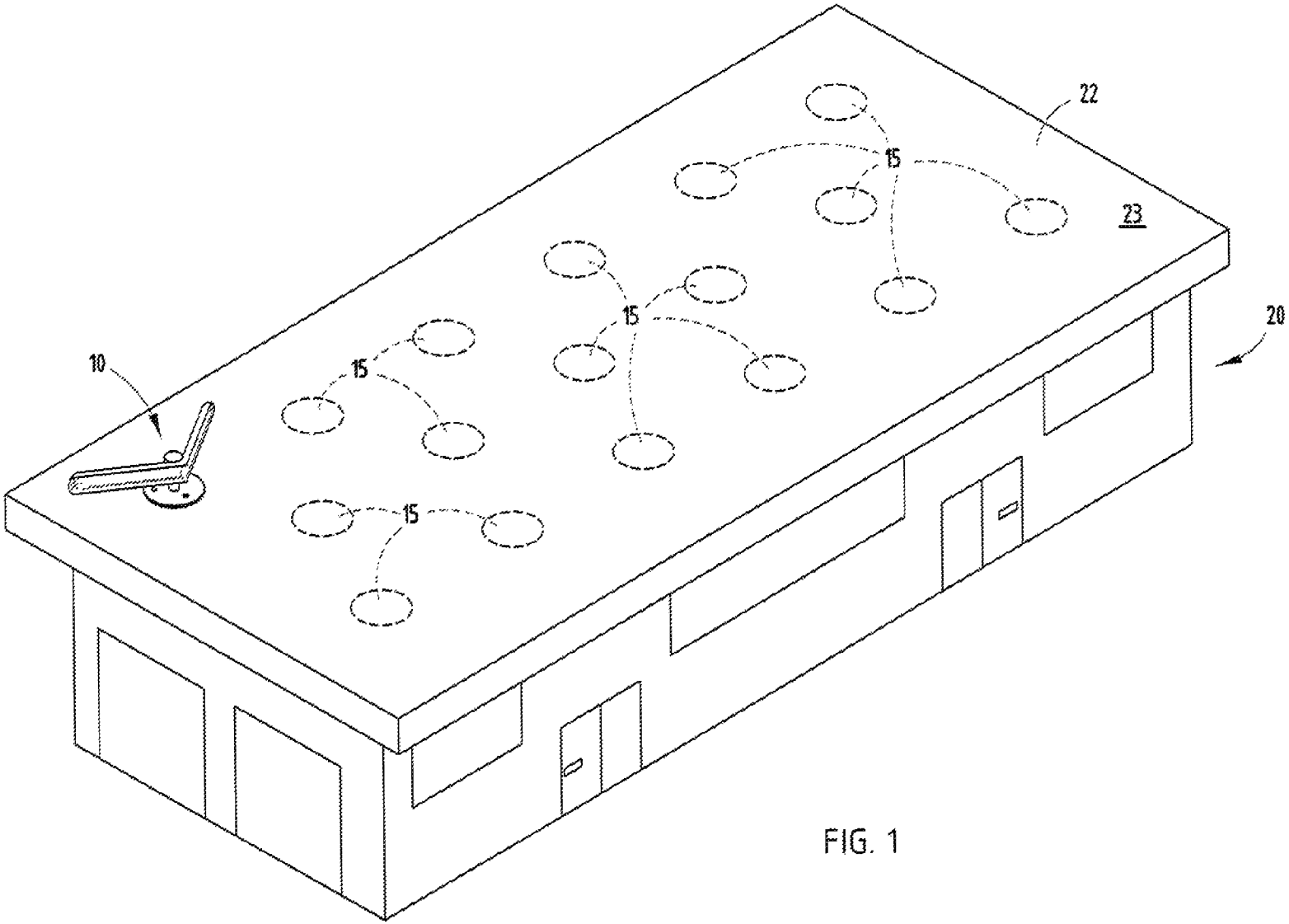
FIG. 1 is a perspective view of a flat roofed building showing locations of airfoils on the roof of the building by the dotted line circles and showing one embodiment of an airfoil spoiler mounted to the roof of the building.

The spoilers of the invention can be employed for either flat roofs 22 or slightly pitched roofs of a building 20 (FIG. 1) to disturb high velocity laminar airflow which would otherwise reduce the air pressure at the surface of the roof causing lift, which could tear the roof from the building. The surface 23 of roof 22 is typically comprised of a covering sheet of water-impervious material, such as tar paper, PVC, or other sheet material, which comprise individual strips joined at seams by seals and adhesively attached to the underlying roof support sheeting. The roof support sheeting is frequently made of plywood or chipboard sheets. Often surface 23 will include small pea-sized stones, such as pea gravel, to assist in holding the water-impervious material to the underlying structure. Nonetheless, under high wind conditions encountered during wind storms, such as sheer winds, and hurricanes, the surface material 23 frequently lifts off the roof and, in many cases, takes the underlying support structure with it.

Figure 3:
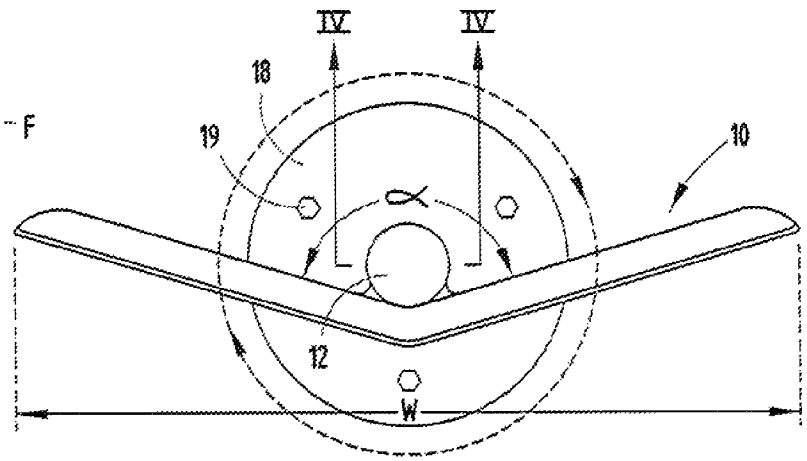
FIG. 3 is a top plan view of the spoiler shown in FIG. 2.
Figure 2:
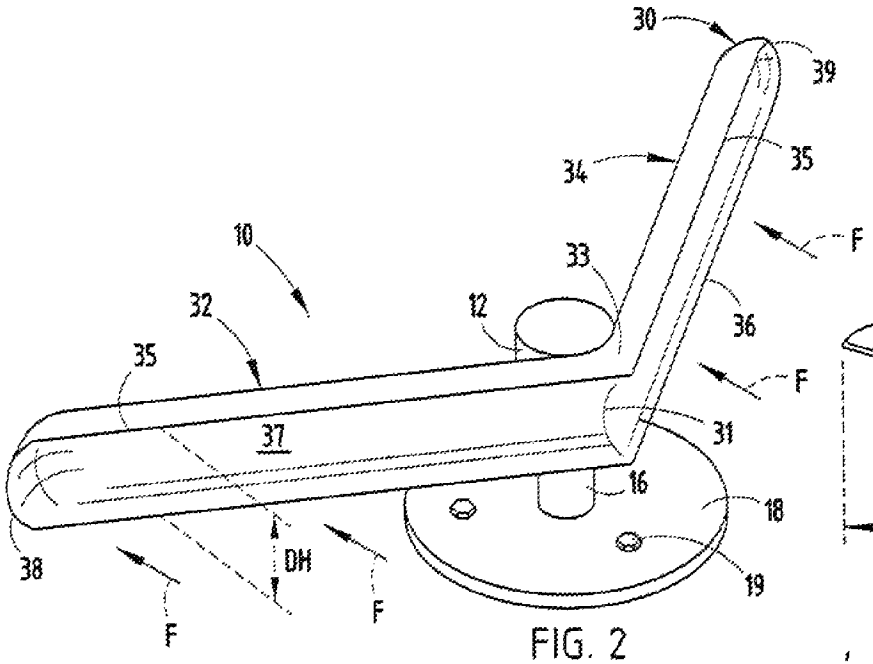
FIG. 2 is an enlarged perspective view of the spoiler shown in FIG. 1.
Figure 4:
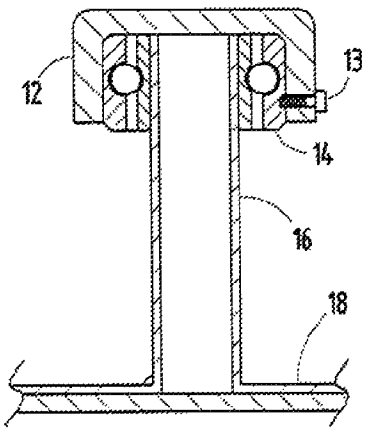
FIG. 4 is a cross-sectional view of the spoiler, taken along section line IV-IV of FIG. 3.

By mounting a plurality of spaced-apart spoilers 10, which are rotatably mounted and shaped to automatically align in response to the wind force (arrows F in FIG. 2) to face into the wind at the surface of the roof, the airflow becomes turbulent preventing or greatly reducing lift forces. Many spoilers, such as spoiler 10 of FIGS. 1-3, is pivotally mounted by a housing 12 to a bearing 14, such as shown in FIG. 4, coupling the spoiler 10 to a mast 16 which is suitably attached to a mounting flange 18. Flange 18 is secured to the roof 22 by fasteners 19 (FIGS. 2 and 3), such as bolts, in a sealed manner. These spoilers pivot to align with the wind due to the generally V-shaped design (as viewed from the top) as they disturb the laminar flow which otherwise occurs during a wind storm. This turbulence prevents the laminar flow from decreasing the air pressure immediately adjacent the roof and eliminates or greatly reduces the lift which otherwise tends to lift the roof sheeting and underlayment from the building structure.

Depending on the building size and, therefore, the roof area, several airfoils may be employed and spaced at appropriate spaced-apart locations 15 (FIG. 1) to cause the turbulence of the wind flow path across the surface 23 of the roof 22, thereby preventing damage to the roof. In many cases, the airfoil is designed to align with the wind and is V-shaped to cause a sufficient amount of turbulence to prevent laminar flow immediately adjacent the roof in the area served by the airfoil. The spoilers 10 can be molded of a suitable polymeric material, such as polycarbonate, glass-reinforced nylon, or fiberglass. Alternatively, they can be stamped or otherwise formed of metal, such as aluminum, steel, or stainless steel. If formed of aluminum or steel, they may be treated by anodizing or galvanizing or otherwise covered to provide weather resistance.

The size of the spoilers can be varied depending upon the application, although an about 3 to about 5 foot wingspan W (FIG. 3) is a typical width. The vertical height H (FIG. 2) may vary from about 12 to about 24 inches, and the mast height is selected to achieve the desired turbulence. The thickness of the molded polymeric spoilers is from about 1 to about 2 inches. Typically, the mast 16 positions the lower edge 36 of the spoiler 10 about 6 to 8 inches from the roof surface 23. The bearings 14 are selected to withstand the anticipated wind loads as in the diameter of the mast 16 and its mounting flange 18. The bearing is conventionally coupled to the mast and secured within the spoiler housing 12 by a plurality of set screws 13 (FIG. 4) to assure the free rotation of the spoiler to align with the wind.

The spoiler 10, shown in FIGS. 1-4, comprises a body 30 which includes a pair of legs 32 and 34 which are integrally formed, as by molding using the materials described above, and are joined at the center 33 to housing 12 at an angle $\propto$, as best seen in FIG. 3, of from about 90° to about 150°. Each leg 32 and 34 includes an upper edge 35 and a lower edge 36. The legs include concave surfaces 37 between edges 35 and 36 with cup-shaped enclosed ends 38 and 39. The junction of the concave surfaces 37 of legs 32 and 34 form a vertically extending edge 31 extending between upper edge 35 and lower edge 36 and assists in dividing the force of the wind on the spoiler evenly, such that it aligns with the incoming wind, causing the otherwise laminar flow to become turbulent, spiraling around horizontal axes parallel to the surface 23 of the roof. This breaking up of the laminar wind prevents it from causing lift forces sufficient to damage the roof.

Figure 5:
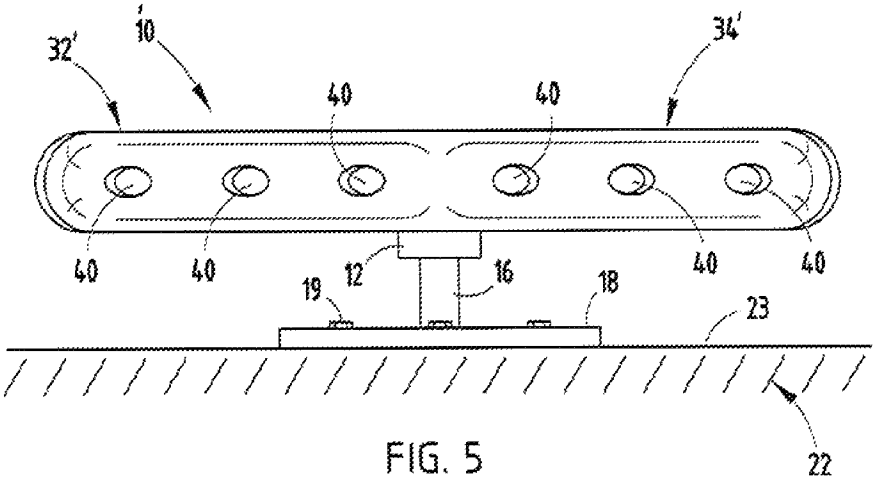
FIG. 5 is a front elevational view of an alternative embodiment of the spoiler shown in FIG. 2, including several apertures formed through the body of the spoiler.

The spoiler shown in FIGS. 1-4 may include a plurality of apertures, as shown by the spoiler 10' in FIG. 5, in which the spoiler shape is identical to that shown in FIGS. 1-4 but the legs 32' and 34' include a plurality of apertures 40 extending therethrough, which reduce the wind resistance of the spoiler and further increase the turbulence by providing additional passageways via apertures 40 through which the wind can pass. Apertures 40 have a diameter of approximately one-third that of the height H of the spoiler, namely, from about 4 to about 8 inches in diameter to provide the desired passage of wind therethrough.

Figure 7:
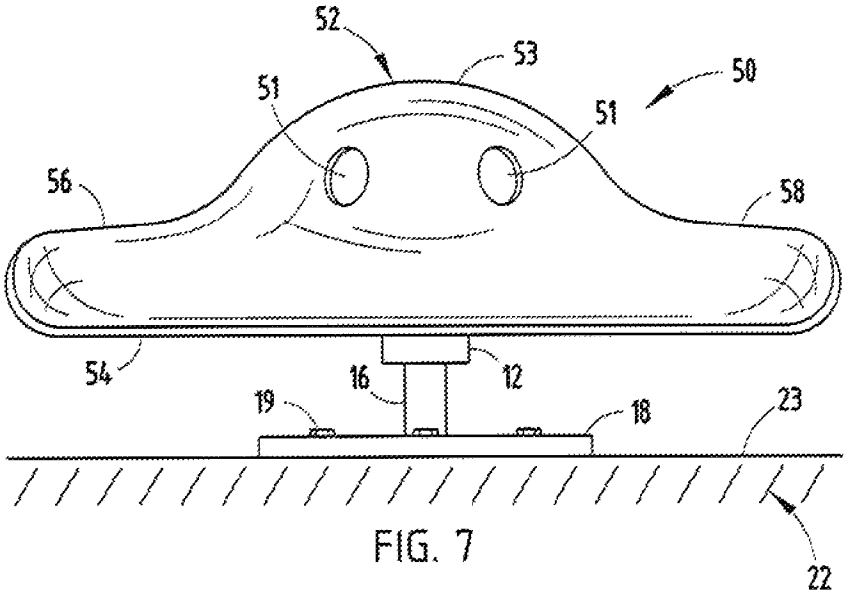
FIG. 7 is a front elevational view of the spoiler shown in FIG. 6.
Figure 8:
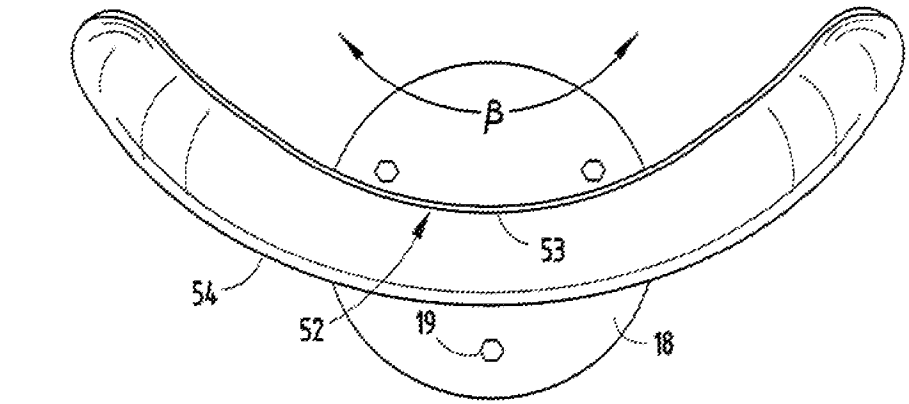
FIG. 8 is a top plan view of the spoiler shown in FIG. 6.
Figure 6:
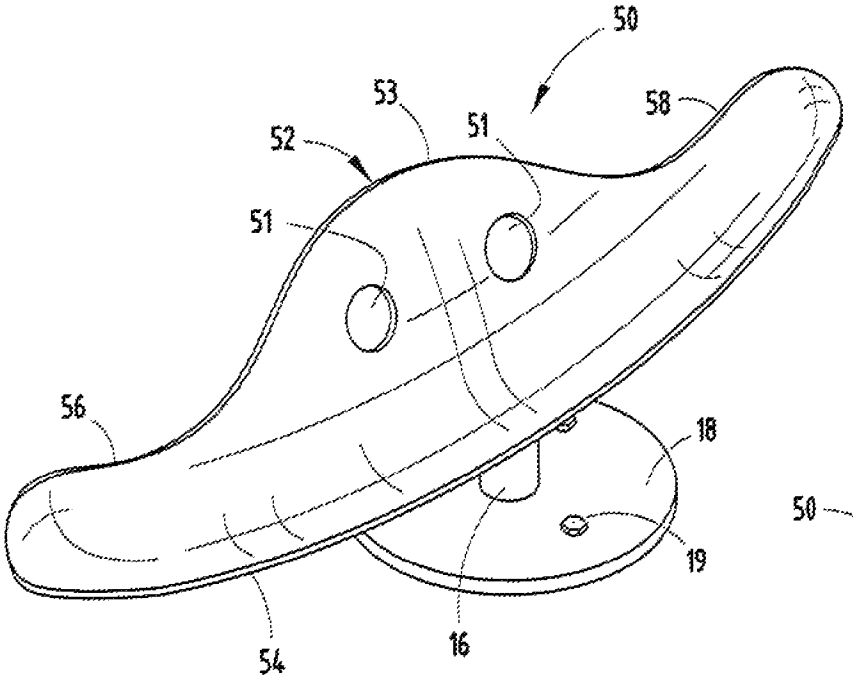
FIG. 6 is a perspective view of an alternative design for a three-dimensional curvilinear spoiler having a raised central section with apertures therethrough.

An alternative embodiment of the spoilers shown in the earlier figures is shown in FIGS. 6-8 where a curvilinear spoiler 50 is shown. Spoiler 50 is mounted to the surface of a roof utilizing a mounting flange 18, mast 16, and housing 12 and bearing 14, similar to the mounting in the previous embodiments. The spoiler 50 has a generally curved and concavely shaped body, as viewed in FIG. 8, with a forwardly curved and raised upper center section 52 and a forwardly and outwardly curved lower lip 54 which extends along the entire length of the spoiler body. Spoiler 50 is curved, as shown in FIG. 8, occupying an arc $\beta$ of approximately 90°-140°. The ends 56 and 58 of spoiler 50 occupy approximately one-quarter of the overall width of the spoiler, while the center section occupies at least approximately one-half. The height of the end sections 56 and 58 are from about 12 to about 24 inches. The height of the curved dome of the center section 52 is at least twice that of legs 56, 58 (i.e., about 24 to about 48 inches). Preferably, spoiler 50 includes a pair of apertures 51 for the passage of wind therethrough. Apertures 51 have a diameter similar to apertures 40 shown in the FIG. 5 embodiment, although they can have a somewhat larger diameter inasmuch as they are formed in the increased height center section 52 of the spoiler. As can be seen in FIGS. 6 and 8, the top lip 53 of the center section 52 of the spoiler 50 does not extend forwardly as does the lower lip 54 and, therefore, the wind striking the spoiler, in addition to being disturbed, will tend to push downwardly on the spoiler 50 to improve the resistance of the roof to wind damage.

Figure 10:
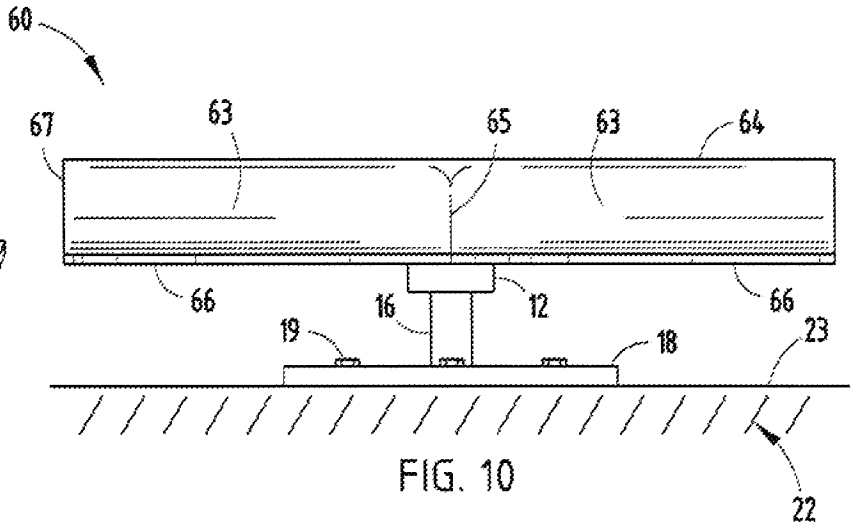
FIG. 10 is a front elevational view of the spoiler of FIG. 9.
Figure 11:
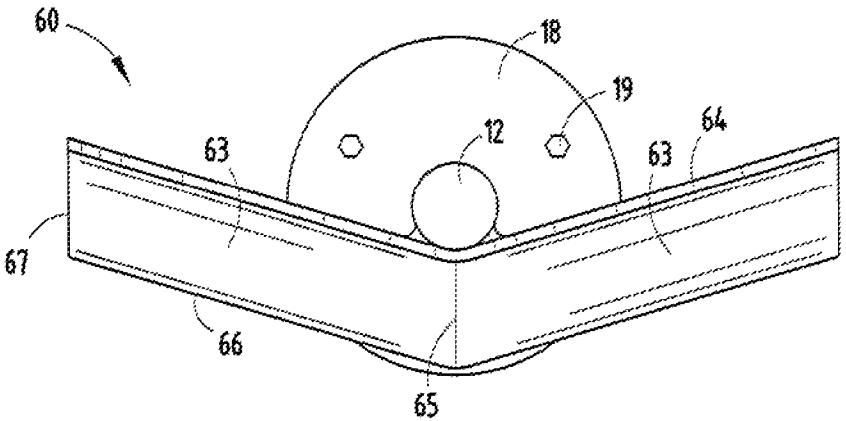
FIG. 11 is a top plan view of the spoiler design of FIG. 9.
Figure 9:
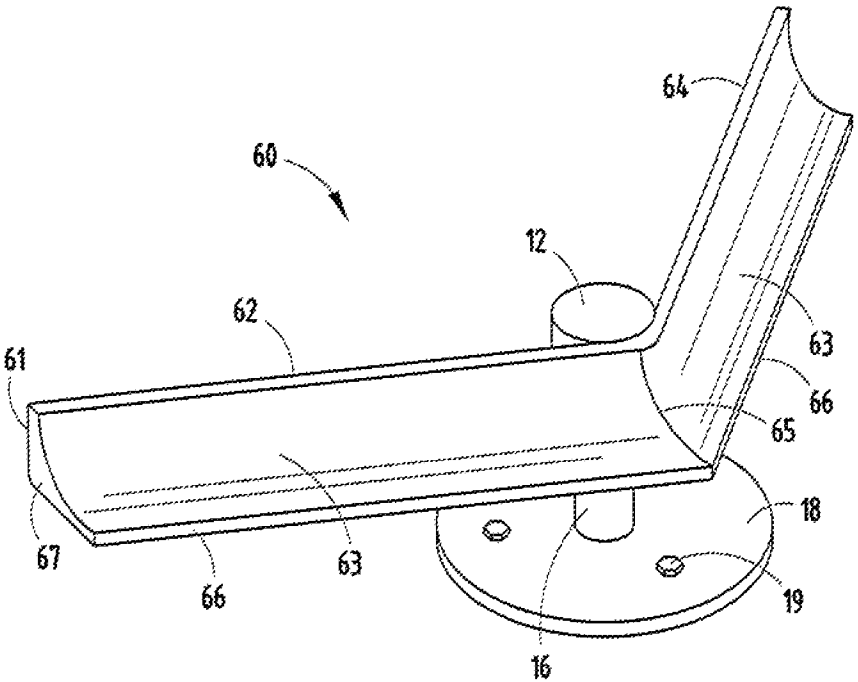
FIG. 9 is a perspective view of another embodiment of the invention showing a generally plow blade-shaped spoiler design.

An alternative embodiment of the spoiler is shown in FIGS. 9-11 in which a generally plow-shaped spoiler 60 is shown and, likewise, is mounted to the surface 23 of a roof 22 by means of a mounting flange 18, securing bolts 19, a mast 16, and a housing 12 including a suitable bearing, as in the first embodiment. The spoiler 60 is also generally V-shaped as is spoiler 10 in the FIGS. 1-4 embodiment and was formed in a V at about the same angle. The legs 62 and 64 of the spoiler thus converge at an angle of from about 90° to about 150°. The legs, however, have a generally vertically extending rear wall 61 and a concave surface 63 which join at a center edge 65. The lower lip 66 of the spoiler 60 is generally horizontal and extends forwardly in a generally plow-shaped configuration, as best seen in FIG. 9. This configuration allows a more robust body for the spoiler 60 in the fillet area 67 (FIG. 9) and, as in the proceeding embodiment, responds to the wind impinging upon the spoiler by not only causing wind to become turbulent, thereby preventing the lifting effect, but also tends to push downwardly on the spoiler for assisting in holding the roof in place.

Figure 13:
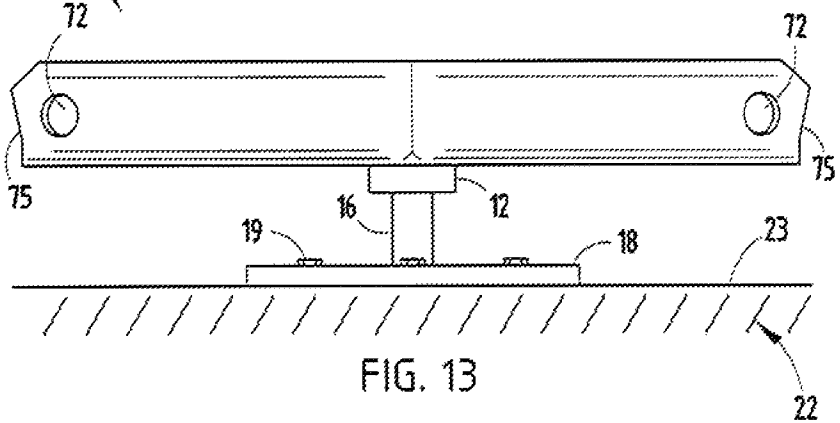
FIG. 13 is a front elevational view of an alternative embodiment of the spoiler of FIG. 12.
Figure 14:
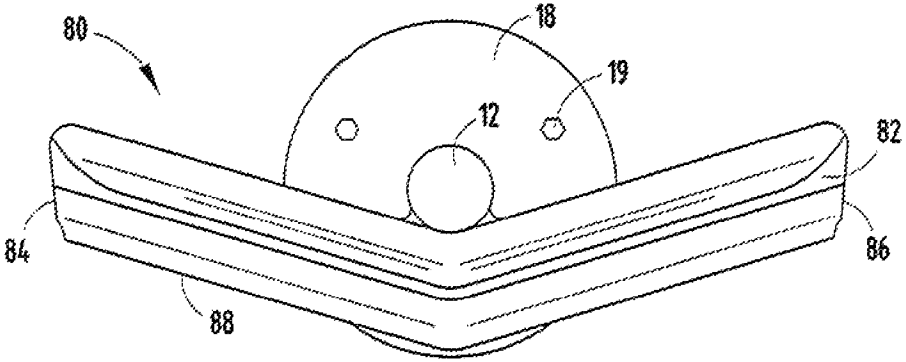
FIG. 14 is a top plan view of yet another embodiment of a spoiler.
Figure 12:
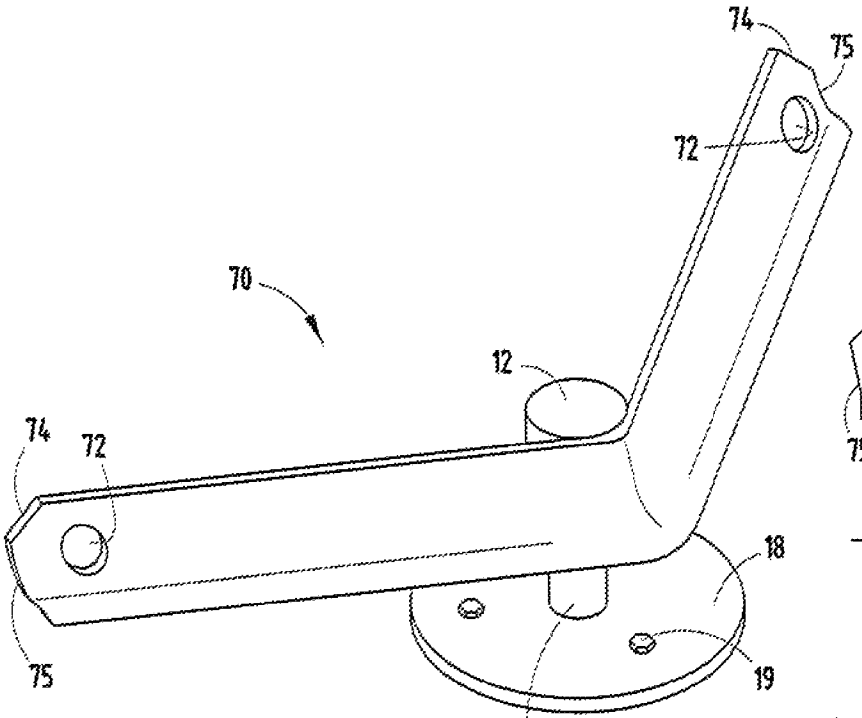
FIG. 12 is a perspective view of another configuration of a generally plow blade-shaped design, with the configured ends having apertures therethrough.

The ends of the spoilers shown in the preceding four embodiments may be configured to provide further turbulence as, for example, shown in the spoilers of FIGS. 12-14. These spoilers likewise are generally V-shaped forming an angle, such as shown by angle $\alpha$ in FIG. 3, of from about 90° to about 150°, and may include apertures, such as apertures 72 near the tip of spoiler 70 shown in FIG. 12. Each of the spoilers have ends which may include a tapered edge, such as 74 shown in FIGS. 12 and 13, and are downwardly curved at 75 to provide additional wind disturbing edges at the outermost edge of the spoilers.

Spoiler 80, shown in FIG. 14, likewise has a generally V-shaped, plow-like configuration with a forwardly projecting upper lip 82 and tapered outer edges 84 and 86. The body of spoiler 80 is likewise generally concave shaped, as is the body of spoiler 10 shown in FIGS. 1-4. The upper lip 82 of spoiler 80 extends forwardly a lesser degree than the lower lip 88.

Each of these embodiments have dimensions and construction materials commiserate with that described in the first embodiment of FIGS. 1-4 and may optionally include a plurality of apertures, as shown in the embodiment of FIG. 5.

Figure 16:
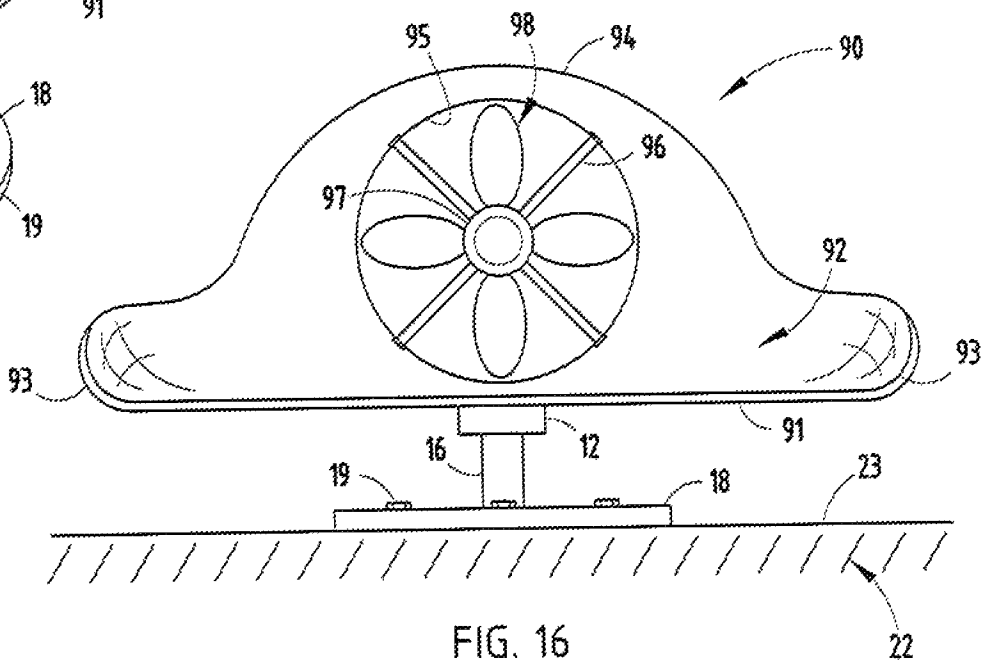
FIG. 16 is a front elevational view of the spoiler shown in FIG. 15.
Figure 15:
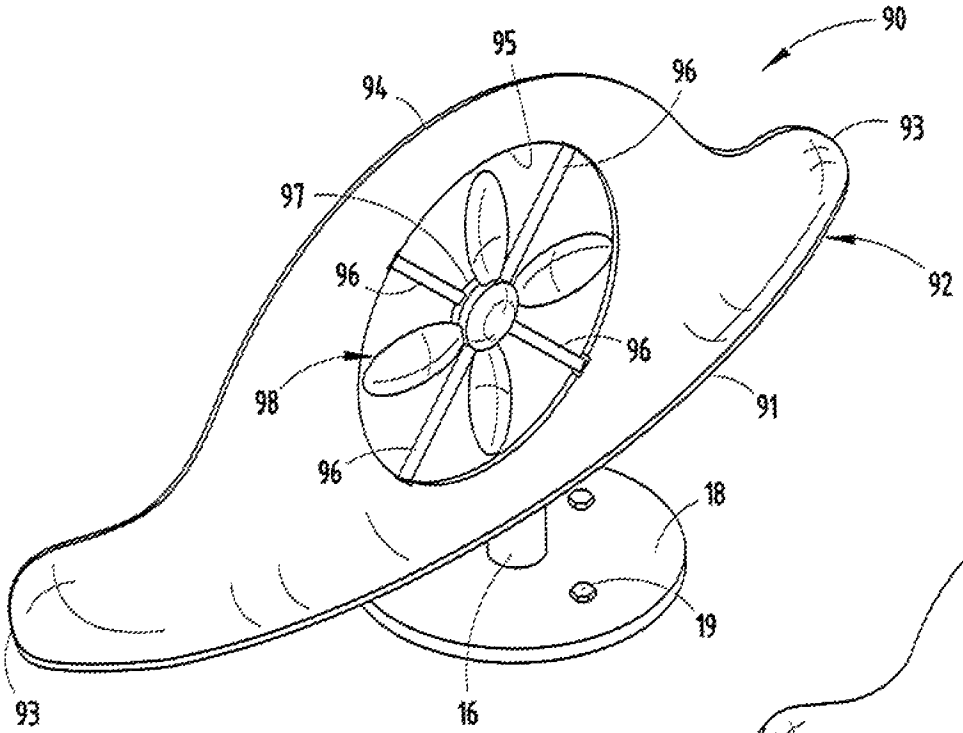
FIG. 15 is a perspective view of an alternative design for a three-dimensional curvilinear spoiler having a raised central section with a freewheeling turbulence producing fan mounted therein.

The embodiments in FIGS. 15 and 16 comprise a spoiler which has a configuration somewhat similar to that shown in the embodiment of FIGS. 6-9, namely, curvilinear spoiler 90 with a smoothly curved, rounded lower section 92 having rounded ends 93. Lower section 92 is generally concave with a forwardly extending lip 91 which circumscribes an arc β similar to that of the FIGS. 6-8. Spoiler 90 extends upwardly in an integral raised center section 94 which is significantly higher than the upper section 52 of the FIGS. 6-8 embodiment. The center section 94 is from about two to about four feet in the vertical direction and includes a large central aperture 95, the edge of which supports four orthogonal support struts 96 supporting a bearing 97 of a freewheeling fan 98. Thus, the spoiler 90, as shown in FIGS. 15 and 16, provides additional turbulence through the action of the wind spinning the four blades of fan 98, causing additional turbulence as the wind passes through aperture 95. The diameter of aperture 95 is from about 18 to about 36 inches, while the diameter of the four-bladed fan 98 is from about 17 to about 35 inches. The material and width of the spoiler 90 is substantially the same as in prior embodiments, although the thickness may be somewhat greater than the about 1-2 inch thickness of the remaining embodiments to support the struts 96 and fan 98 therein. Spoiler 90 is curved in a semicircle and has a radius of curvature of from about 24 to about 48 inches.

Figure 18:
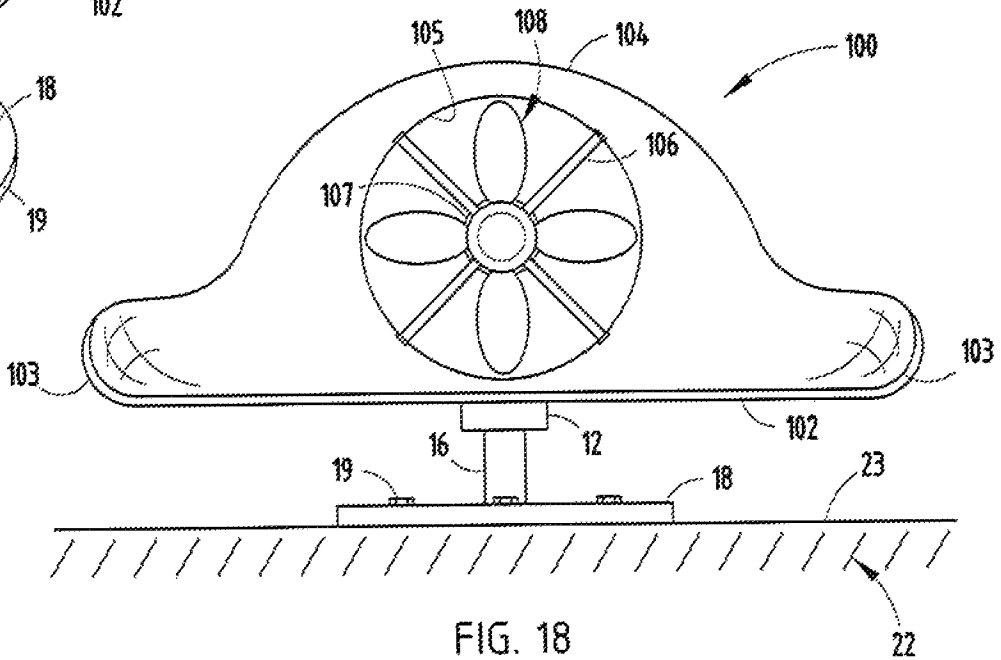
FIG. 18 is a front elevational view of the structure of FIG. 17.
Figure 17:
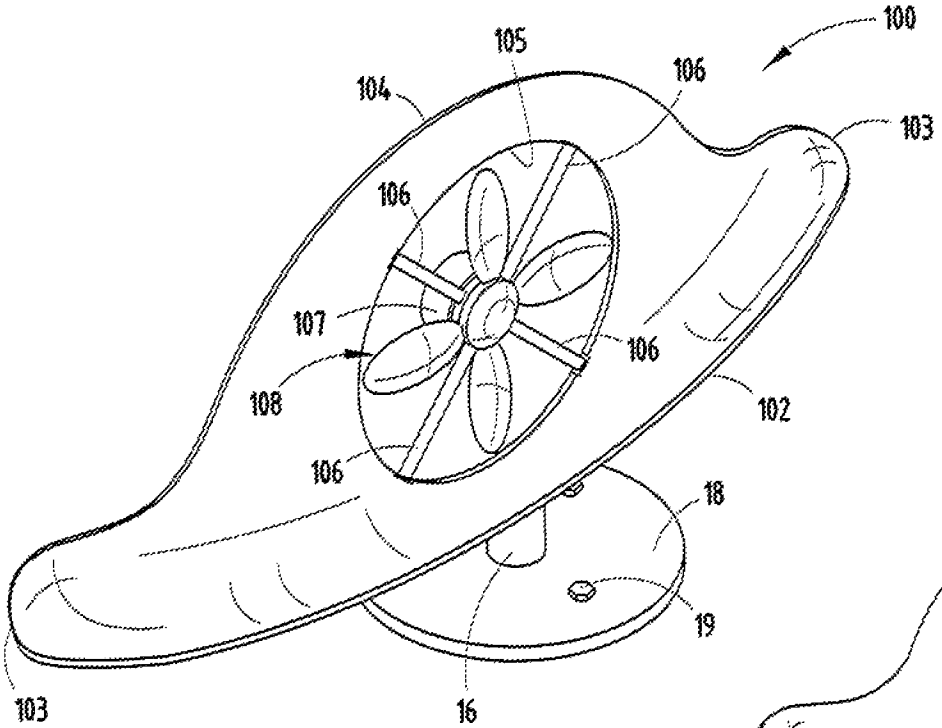
FIG. 17 is a perspective view of an alternative design for a three-dimensional curvilinear spoiler having a raised central section with a wind generator mounted therein.

The embodiment shown in FIGS. 17 and 18 is a spoiler having a geometry substantially the same as spoiler 90, with the exception that the bearing 97 is replaced with a generator 107 which is driven by fan blades 108 with generator 107 supported by orthogonal struts 106 extending from the edges of aperture 105 in the raised center section 104 of the spoiler 100. Again, the lower section 102 is concavely curved with rounded ends 103 to, in essence, scoop the wind, as in the previous embodiment shown in FIGS. 15 and 16, upwardly into the aperture 105 where the generator is activated by the wind. The conductors (not shown) leading from the generator 107 extend through one of the struts 106 which is hollow and to slip rings on housing 12 which interface with conductors leading through mast 16 to the building where conductors from each of the plurality of generators, positioned such as shown in FIG. 1, are coupled to an electrical control circuit, such as an inverter or other power control circuit which converts the voltage from the generator to one which can be employed either to charge a battery pack for subsequent conversion to 110 volt AC or one which operates an inverter directly. Such power control and inverting circuits are well known in the wind generating industry and can be of conventional design. The generator 107 can be a DC or an AC generator.

Figure 19:
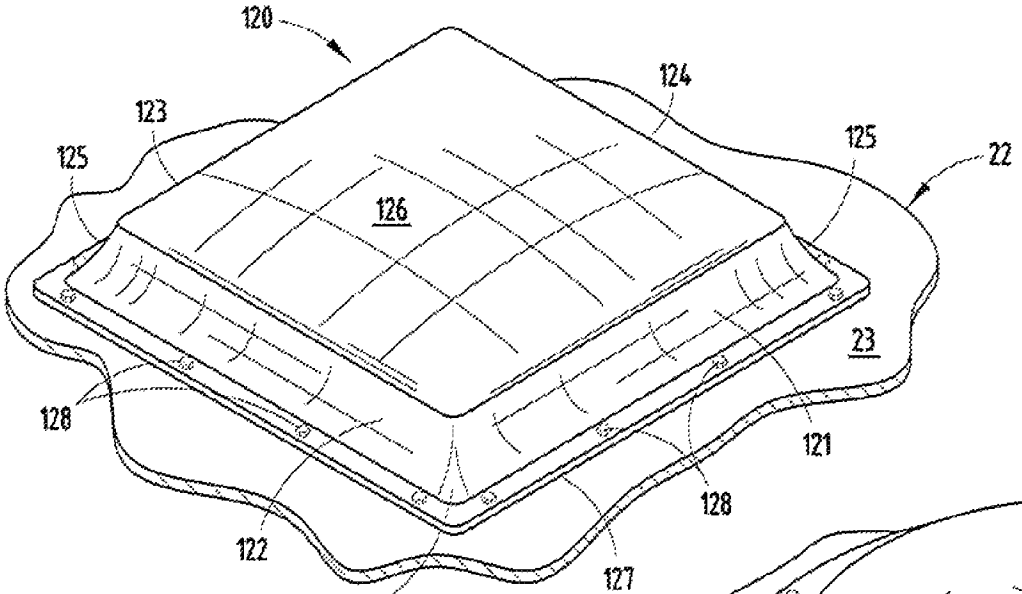
FIG. 19 is a perspective view of an alternative embodiment of an air foil which may be employed in an installation such as illustrated in FIG. 1.
Figure 20:
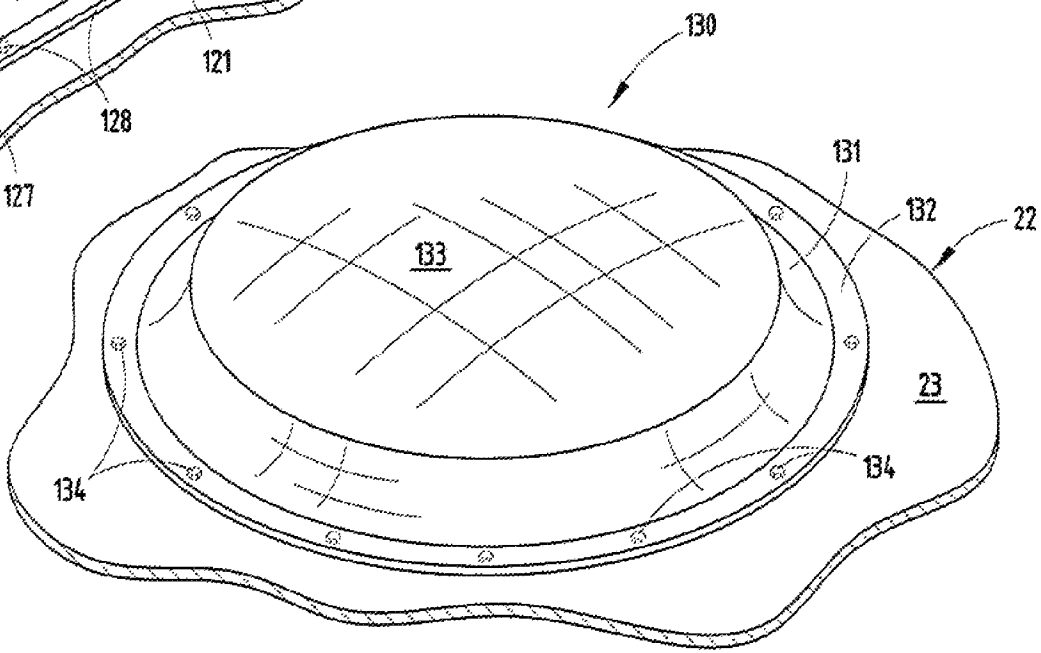
FIG. 20 is a perspective view of another alternative embodiment of an air foil which may be employed in an installation such as illustrated in FIG. 1.

Alternative embodiments to the previously described rotatable spoilers are shown in FIGS. 19 and 20. FIGS. 19 and 20 show omnidirectional fixed spoilers which can be positioned in an array in spaced relationship in rows and columns on a roof as shown by the installation of FIG. 1. In FIG. 19, an omnidirectional spoiler 120 is shown which has a generally square shape (as viewed from the top) and includes four concavely curved side walls 121-124, which are joined at curved intersecting corners 125. The side walls are integrally formed with a convexly domed top 126 at the upper edges of the side walls that flare out at the bottom to form a peripheral flange 127 extending around the spoiler 120 and which receives fasteners, such as lug bolts 128, for securing the spoiler 120 to the surface 23 of a roof 22. The length of each of the side walls 121-124 is from about 3 feet to about 6 feet, while the height of the integrally molded spoiler 120 is from about 18 inches to about 24 inches measured from the flange 127 to the top of domes top 126. The spoiler 120 can be economically manufactured by blow molding, injection molding, or the like out of a polymeric material, such as PVC, although a more robust material, such as polycarbonate, glass-reinforced nylon, fiberglass, or the like, or a weather-impervious metal or treated metal can be employed, such as aluminum, galvanized steel, or the like, in which case they can be formed by progressive die stamping. The fixed spoiler 120 has the advantage of being somewhat less expensive to manufacture in that it has no moving parts and does not require bearings or a mounting mass and can be shipped in a nesting relationship to an installation for subsequent mounting to a roof in an array as shown in FIG. 1.

FIG. 20 shows an alternative embodiment of an omnidirectional spoiler 130, which is manufactured of the same materials as discussed in connection with spoiler 120 and has a circular or round configuration as viewed from the top and a peripheral side wall 131 which is concavely curved and terminates at its lower edge in a peripheral mounting flange 132. Spoiler 130 integrally includes a convexly domed circular top 133. The spoiler 130 is mounted to the surface 23 of a roof 22 by means of a plurality of fasteners, such as lug bolts 134. As in the embodiment of FIG. 19, the overall dimensions of the spoiler 130 includes a diameter of from about 3 feet to about 6 feet and a height of from about 18 inches to about 24 inches. In either of the omnidirectional spoilers shown in FIGS. 19 and 20 regardless of the wind direction, a linear wind will always impinge upon a concavely curved surface and the domed top of the device and, therefore, be deflected upwardly in a spiral pattern to cause turbulence to the wind and reduce or eliminate lifting effect on the roof itself.

Thus, with the system of the present invention, a variety of different configured spoilers can be provided for causing turbulence of wind across the surface of a flat or relatively low pitched roof to prevent lifting forces during high wind conditions. In one embodiment, the spoiler incorporates a wind driven generator for combining the turbulence generating effect together with the generation of electrical power not only during a severe wind storm but whenever sufficient wind is present to operate the generators. The system of the present invention provides protection against roof damage during high wind conditions and assists in maintaining the roof's integrity during storms.

It will become apparent to those skilled in the art that various modifications to the preferred embodiment of the invention as described herein can be made without departing from the spirit or scope of the invention as defined by the appended claims.

The invention claimed is:

1. An air turbulence-creating device for a roof comprising:

a spoiler including a center section and a pair of opposing legs lying in a common plane that extends generally parallel to the roof and only rotating within the plane when in a building-mounted position, the spoiler defining a shape configured to cause the opposing legs to point toward a downwind direction; and a rotatable mount for mounting said spoiler to the roof, such that the spoiler aligns with the wind.

2. The device as defined in claim 1 wherein said spoiler has a concave body along a vertical axis.

3. The device as defined in claim 2 wherein said spoiler is generally V-shaped with a pair of legs which converge at an angle of from about 90° to about 150°.

4. The device as defined in claim 1 wherein said spoiler has a curved body which circumscribes an arc of from about 90° to about 140°.

5. The device as defined in claim 1 wherein said spoiler has a plurality of apertures extending therethrough.

6. The device as defined in claim 1 wherein said spoiler has a raised portion in the center section.

7. The device as defined in claim 6 wherein said raised section includes an aperture and a freewheeling fan mounted within said aperture.

8. The device as defined in claim 6 wherein said raised section includes an aperture and a wind-driven generator mounted within said aperture.

9. The device defined in claim 1, wherein the plane extends generally horizontally.

10. The device defined in claim 1, wherein the shape of the spoiler includes a front surface defining a forward-facing concavity.

11. A system for preventing a roof from being damaged by excessive wind comprising:

a plurality of airfoils positioned at spaced locations on the roof, wherein each of said airfoils comprises a spoiler and a rotatable mount for mounting each of said spoilers to the roof; the spoilers each including a center section and a pair of opposing legs lying in a common plane that extends generally parallel to the roof and only rotating within the plane when in a building-mounted position, the airfoils each defining a shape configured to cause the opposing legs to point toward a downwind direction.

12. The system as defined in claim 11 wherein said spoilers are generally V-shaped.

13. The device as defined in claim 12 wherein said spoiler is generally V-shaped with a pair of legs which converge at an angle of from about 90° to about 150°.

14. The system as defined in claim 11 wherein said spoilers are generally curved.

15. The device as defined in claim 14 wherein said spoiler has a curved body which circumscribes an arc of from about 90° to about 140°.

16. The device as defined in claim 11 wherein said spoiler has a plurality of apertures extending therethrough.

17. The device as defined in claim 11 wherein said spoiler has a raised portion in the center section.

18. The device as defined in claim 17 wherein said raised section includes an aperture and a freewheeling fan mounted within said aperture.

19. The device as defined in claim 17 wherein said raised section includes an aperture and a wind-driven generator mounted within said aperture.

20. The device defined in claim 11, wherein the plane extends generally horizontally.

21. The device defined in claim 11, wherein the shape of the spoiler includes a front surface defining a forward-facing concavity.

22. An air turbulence-creating device for a roof comprising:

a spoiler including a center section and a pair of opposing legs defining a configured shape with an aerodynamic front surface configured to cause air turbulence, the front surface defining an upwind-facing concavity; and a rotatable mount for mounting said spoiler to a roof, such that the spoiler aligns with the wind.

23. The device defined in claim 22, wherein a vertical cross section through a middle of each of the legs includes a recess forming the concavity.

24. The device defined in claim 22, wherein the legs define a common plane extending generally parallel to the roof.

25. A system for preventing a roof from being damaged by excessive wind comprising:

a plurality of airfoils positioned at spaced locations on the roof, wherein each of said airfoils comprises a spoiler and a rotatable mount for mounting each of said spoilers to a roof; the spoilers each including a center section and a pair of opposing legs defining a configured shape with an aerodynamic front surface configured to cause air turbulence, the front surface defining an upwind-facing concavity.

* * * * *